US012514374B2

(12) United States Patent
Slade, III et al.

(10) Patent No.: US 12,514,374 B2
(45) Date of Patent: Jan. 6, 2026

(54) MOVING BED ASSEMBLY

(71) Applicant: ZWAY, LLC, Ponte Verda Beach, FL (US)

(72) Inventors: Thomas H. Slade, III, Ponte Verda Beach, FL (US); John Barrett, Sarasota, FL (US)

(73) Assignee: ZWAY, LLC, Ponte Vedra Beach, FL (US)

( * ) Notice: Subject to any disclaimer, the term of this patent is extended or adjusted under 35 U.S.C. 154(b) by 126 days.

(21) Appl. No.: 18/436,420

(22) Filed: Feb. 8, 2024

(65) Prior Publication Data

US 2025/0255417 A1 Aug. 14, 2025

(51) Int. Cl.
*A47C 21/00* (2006.01)

(52) U.S. Cl.
CPC ..... *A47C 21/006* (2013.01)

(58) Field of Classification Search
CPC ..... A47C 21/006; A61H 1/003; A61H 2201/5007; A61H 15/0078; A61H 2201/1207; A61H 2201/14; A61H 2201/1445; A63B 21/00192; A47D 9/057
See application file for complete search history.

(56) References Cited

U.S. PATENT DOCUMENTS 2,819,713 A * 1/1958 Buck ..... A61H 1/001 601/51
5,242,354 A * 9/1993 Seith, Jr. ..... A63B 21/023 482/133
5,625,913 A * 5/1997 Singleton ..... A61G 7/008 5/430
6,061,856 A 5/2000 Hoffmann
6,155,976 A * 12/2000 Sackner ..... A61H 31/008 600/300
7,540,048 B2 6/2009 Piraino
8,615,828 B2 12/2013 Schermel
8,683,629 B2 4/2014 Clenet et al.
8,856,982 B1 * 10/2014 Kalivas ..... A47C 19/021 5/103
9,504,336 B2 11/2016 Dodd
10,376,433 B2 8/2019 Huang
11,413,201 B2 8/2022 Zeng
2007/0214571 A1 9/2007 Piraino
2010/0056965 A1 * 3/2010 Yeh ..... A47C 21/006 310/80
2017/0325591 A1 * 11/2017 Chen ..... A47C 21/006
2019/0191890 A1 6/2019 Huang
2019/0223610 A1 7/2019 Huai
2019/0223612 A1 * 7/2019 Wattereson ..... A47C 21/006
2022/0160141 A1 * 5/2022 Kamei ..... A61G 7/005
2022/0203152 A1 * 6/2022 Chen ..... A63B 21/068
2023/0270261 A1 * 8/2023 Kamei ..... A47C 21/006 5/609
2024/0049888 A1 * 2/2024 Wu ..... A47C 21/006

* cited by examiner

*Primary Examiner* — Myles A Throop
(74) *Attorney, Agent, or Firm* — ALLEN, DYER, DOPPELT + GILCHRIST, P.A.

(57) ABSTRACT

A moving bed assembly includes a base frame supporting a bed frame via a plurality of pairs of swing arms. A drive motor mounted on the base frame drives the bed frame through a continuous motion cycle through a drive shaft. Cranks are mounted at opposite ends of the drive shaft and connected to respective swing arms through respective drive arms. A shaft brake engages the drive shaft to prevent perceptible surges as the bed frame transitions through opposite extremes of the motion cycle.

20 Claims, 17 Drawing Sheets

MOVING BED ASSEMBLY

FIELD OF THE INVENTION

The present invention is directed to moving bed assemblies, and more particularly to moving bed assemblies with bed frames supported by swing arms.

BACKGROUND OF THE INVENTION

While the benefits of a good night's sleep have been appreciated since time immemorial, modern research continues to add depth and breadth to that understanding. Beyond the social, economic and medical costs stemming from a lack of alertness following poor sleep, it is now appreciated that sleep loss (including poor quality sleep) is associated with a litany of other problems, including increased risks of obesity, type 2 diabetes, high blood pressure, memory loss, poor balance, etc.

Equally ancient is the understanding that a rocking motion can facilitate sleep, to which countless generations of tired new parents can attest. While babies are the population segment most likely to experience the sleep benefits of gentle, repetitive motion, there have been numerous proposals for adult beds capable of imparting a repetitive side-to-side or rocking motion. While there is data supporting potential improved sleep from such beds, they are not widely accepted or commercially available.

One likely obstacle to the real world success of such beds is the fact that any sudden discontinuity to the motion cycle of the bed can create a perturbation easily noticeable to a sleeping user. Such perturbations can potentially awaken the user or at least cause an undesirable disruption to the sleep cycle, thereby mitigating the intended sleep benefits of the motion cycle, at best, or decreasing the quality of sleep relative to a stationary bed, at worst.

SUMMARY OF THE INVENTION

In view of the foregoing, it is an object of the present invention to provide an improved moving bed assembly. According to an embodiment of the present invention, a moving bed assembly includes a base frame and bed frame supported over the base frame by first and second pairs of swing arms, a drive shaft driving the bed frame through engagement with the swing arms through first and second driver arms, and a drive motor mounted to the base frame and imparting rotational motion thereto.

The base frame includes pairs of upper and lower base side members and a plurality of upper base cross members extending between the pair of upper base side members, a plurality of base vertical members supporting the pair of upper base side members over the pair of lower base side members. The bed frame arranged over the base frame includes a pair of bed side members and a plurality of bed cross members extending therebetween.

Each of the first and second pairs of swing arms is commonly connected between a respective one of the upper base cross members and a respective one of the bed cross members. Each swing arm of the at least first and second pairs of swing arms includes a pair of base members extending downwardly from base member upper ends attached to opposite sides of the respective one of the upper base cross members to base member lower ends, and a pair a bed members extending downwardly from bed member upper ends attached to opposite sides of the respective one of the bed cross members to bed member lower ends, the pair of base members being located between the pair of bed members.

A first pivot joint pivotably connects the base member upper ends to the respective one of the upper base cross members, and a second pivot joint pivotably connects the base member lower ends to the bed member lower ends.

The drive shaft rotatably mounts to the base frame and extends between a first shaft end and a second shaft end, the first shaft end carrying a first crank located between the first pair of swing arms, the second shaft end carrying a second crank located between the second pair of swing arms. The first drive arm extends between a first drive arm crank end pivotably attached to the first crank and a first drive arm swing end pivotably connected to a first arm mount attached between the pair of base members of one of the first pair of swing arms. The second drive arm extends between a second drive arm crank end rotatably attached to the second crank and a second drive arm swing end rotatably connected to a second arm mount attached between the pair of base members of one of the second pair of swing arms.

According to an aspect of the present invention, the moving bed assembly further includes a shaft brake engaging the drive shaft between the first and second drive arm ends to apply a braking force thereto. The braking force can be adjustable and the shaft brake can be mounted to a side of a transmission through which the drive motor engages the drive shaft.

These and other objects, aspects and advantages of the present invention will be better appreciated in view of the drawings and following detailed description of preferred embodiments.

DETAILED DESCRIPTION OF PREFERRED EMBODIMENTS

Figure 1:
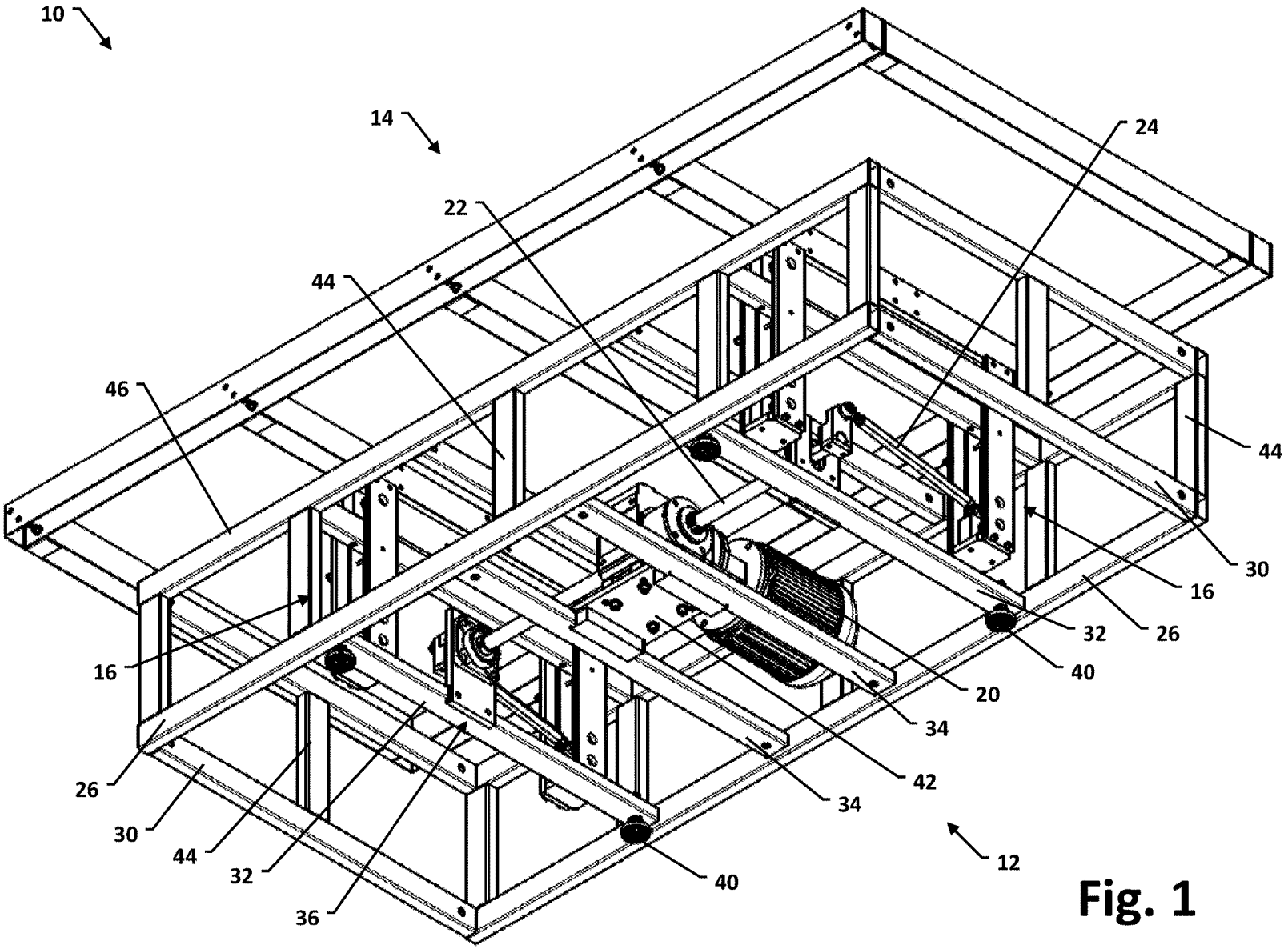
FIG. 1 is lower perspective view of a moving bed assembly, according to an embodiment of the present invention.

According to an embodiment of the present invention, referring to FIG. 1, a moving bed assembly 10 includes a base frame 12 with a bed frame 14 movably supported thereabove by a plurality of swing arms 16. A drive motor 20 is mounted to the base frame 12 and drives the bed frame 14 through a reciprocating motion via a drive shaft 22 and one or more drive arms 24.

The base frame includes a pair of lower base side members 26 with a plurality of lower base cross members 30, 32, 34 extending therebetween. The lower base side and cross members 26, 30 collectively define a lower base frame that supports the base frame 12 on an underlying surface. Outermost lower base cross members 30 collectively define a perimeter of the lower base frame 32 together with the pair of lower base side members 26.

Intermediate lower base cross members 32 support drive shaft end bearings 36 thereabove. Adjustable feet 40 mounted to the intermediate lower base cross members 32 allow a level of the base frame 12 to be adjusted relative to the underlying surface, allowing the lower base frame 32 to be oriented horizontally, regardless of irregularities in the underlying surface. A drive motor mount 42 is supported across the innermost base cross members 34.

Figure 2:
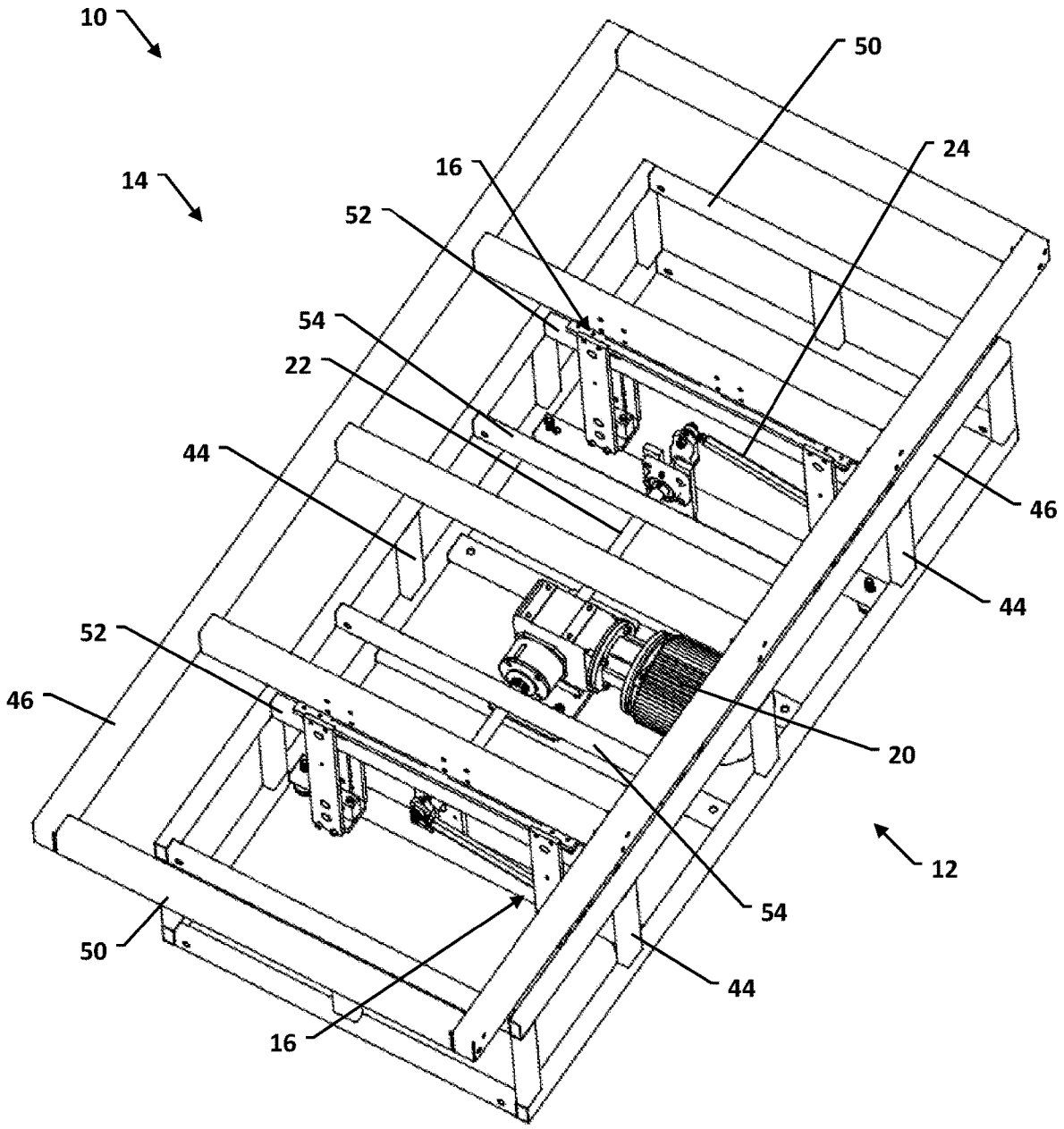
FIGS. 2 and 3 are upper perspective views of the moving bed assembly of FIG. 1.

Referring also to FIG. 2, a plurality of vertical base members 44 support a pair of upper base side members 46 over the lower base side members 26. A plurality of upper base cross members 50, 52, 54 extend between the upper base cross members 46, collectively defining an upper base frame.

Outermost upper base cross members 50 define a perimeter of the upper base frame together with the upper base side members 46. A pair of swing arms 16 are connected to each of the intermediate upper base cross members 52. Innermost upper base cross members 54 add additional stiffness to the upper base frame.

Figure 3:
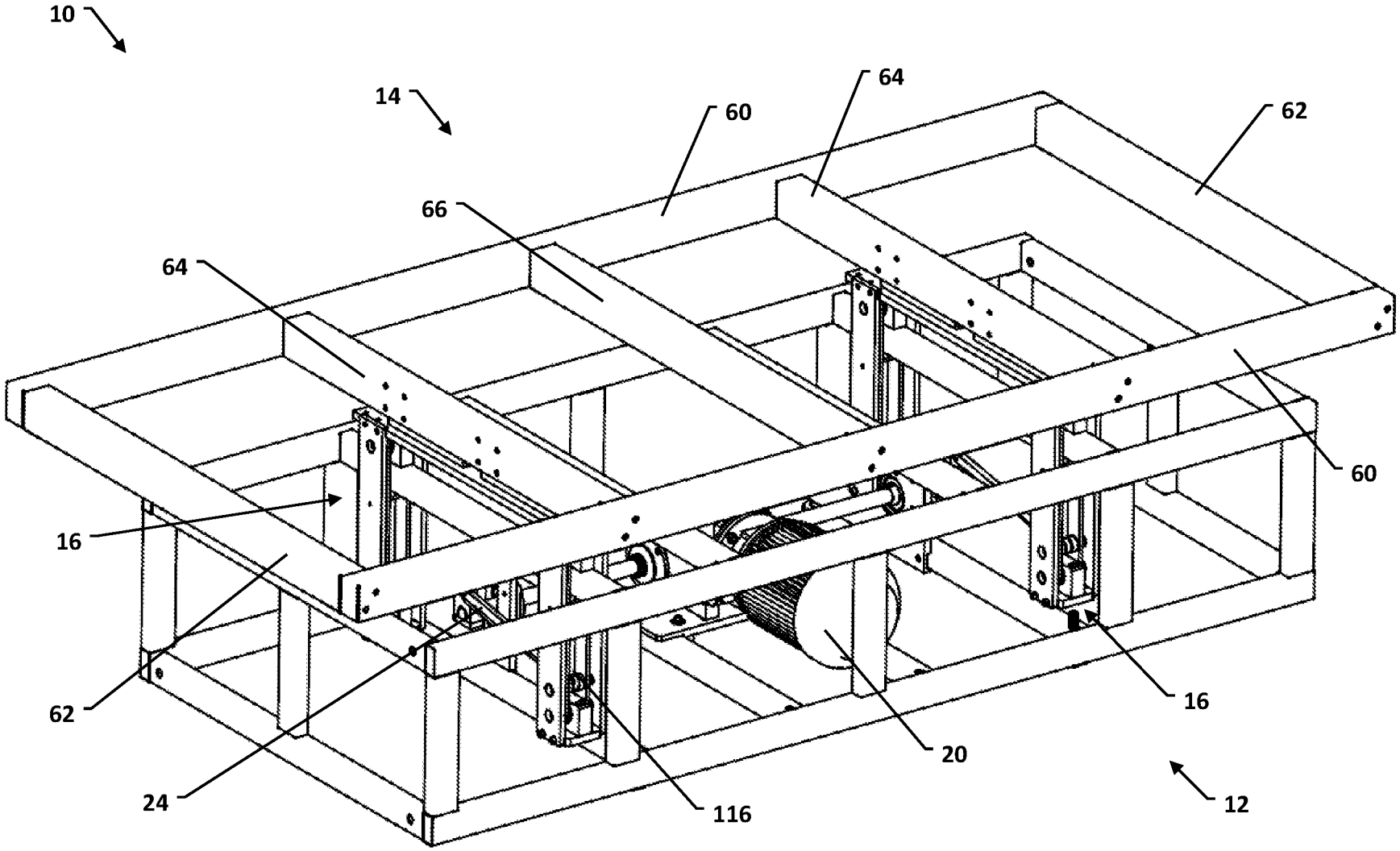
Figure 5:
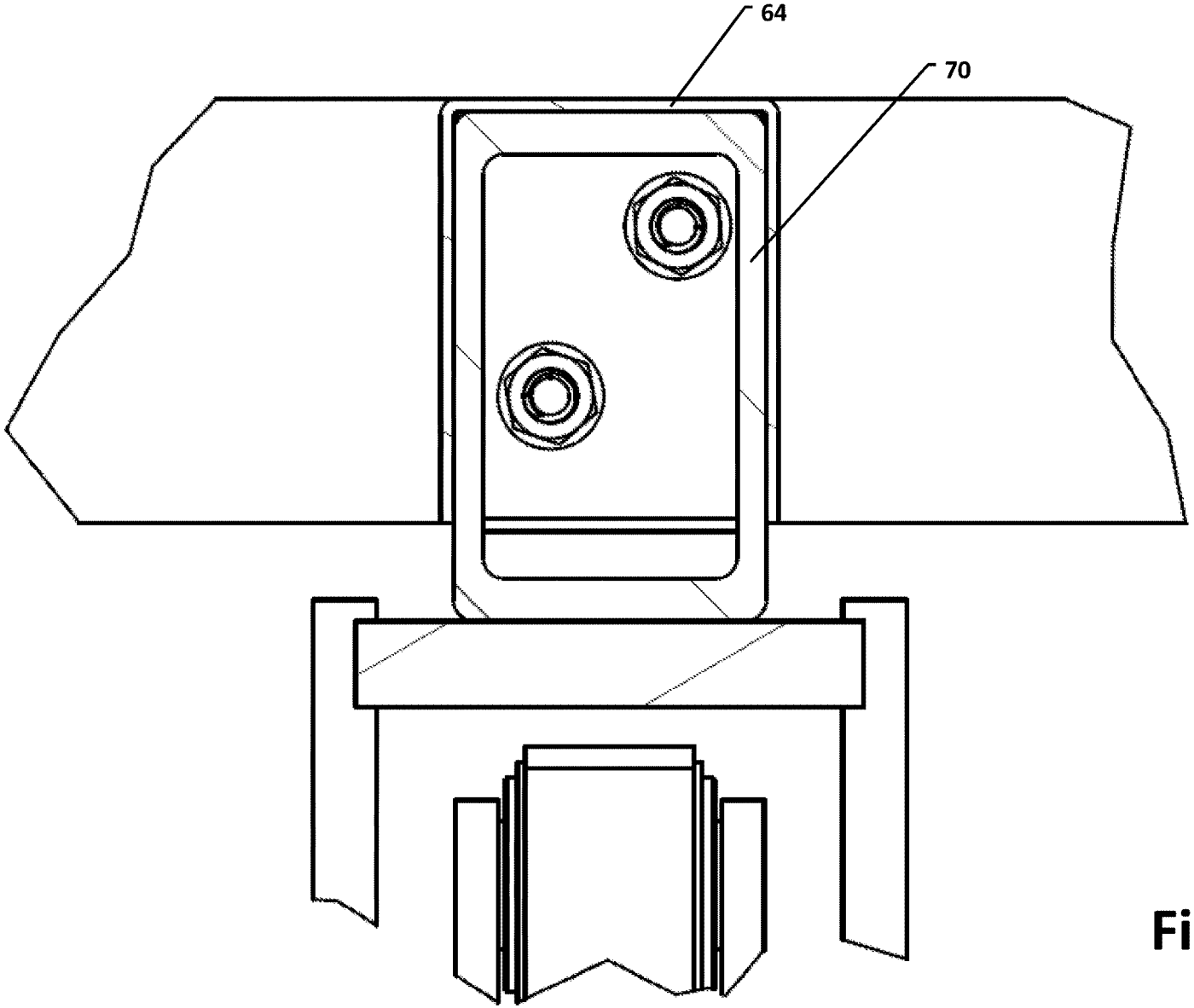
FIG. 5 is a partial sectional view taken along line 5-5 of FIG. 4, with a engagement of a bed frame mounting block within a bed frame cross member.

Referring to FIG. 3, the bed frame 14 includes a pair of bed side members 60 with a plurality of bed cross members 62, 64, 66 extending therebetween. A perimeter of the bed frame 14 is defined by the bed side members 60 and the bed cross members 62, 64, 66. Advantageously, the bed cross members 62, 64, 66 have an inverted-U cross-section. Referring also to FIG. 5, this configuration allows bed frame mounting blocks 70 to extend into the intermediate bed cross members 64 for connecting the bed frame 14 to the swing arms 16. An innermost bed cross member 66 adds additional stiffness to the bed frame 14.

Figure 6:
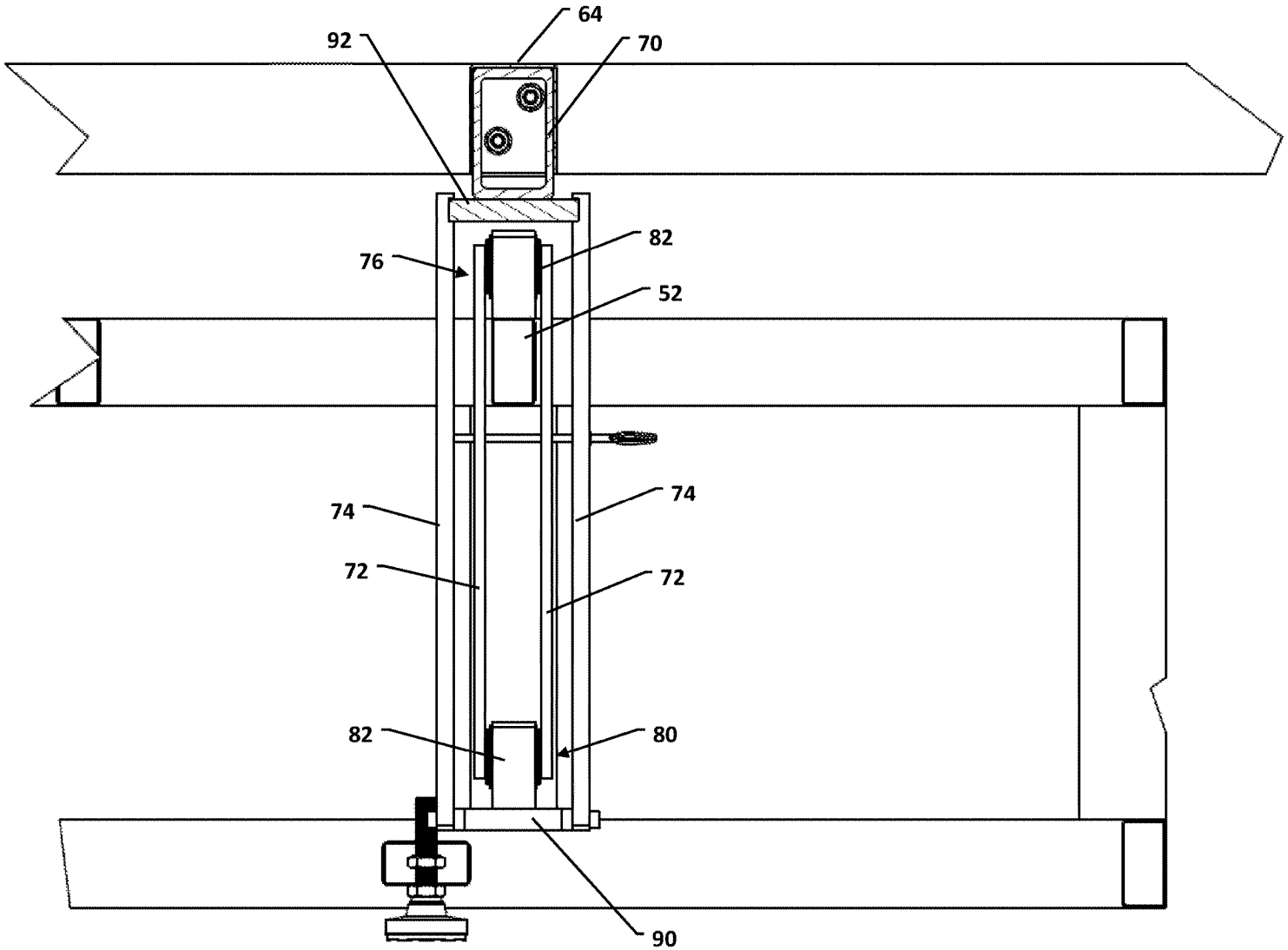
FIG. 6 is a partial sectional view taken along line 6-6 of FIG. 4, with an side view a representative swing arm.
Figure 7:
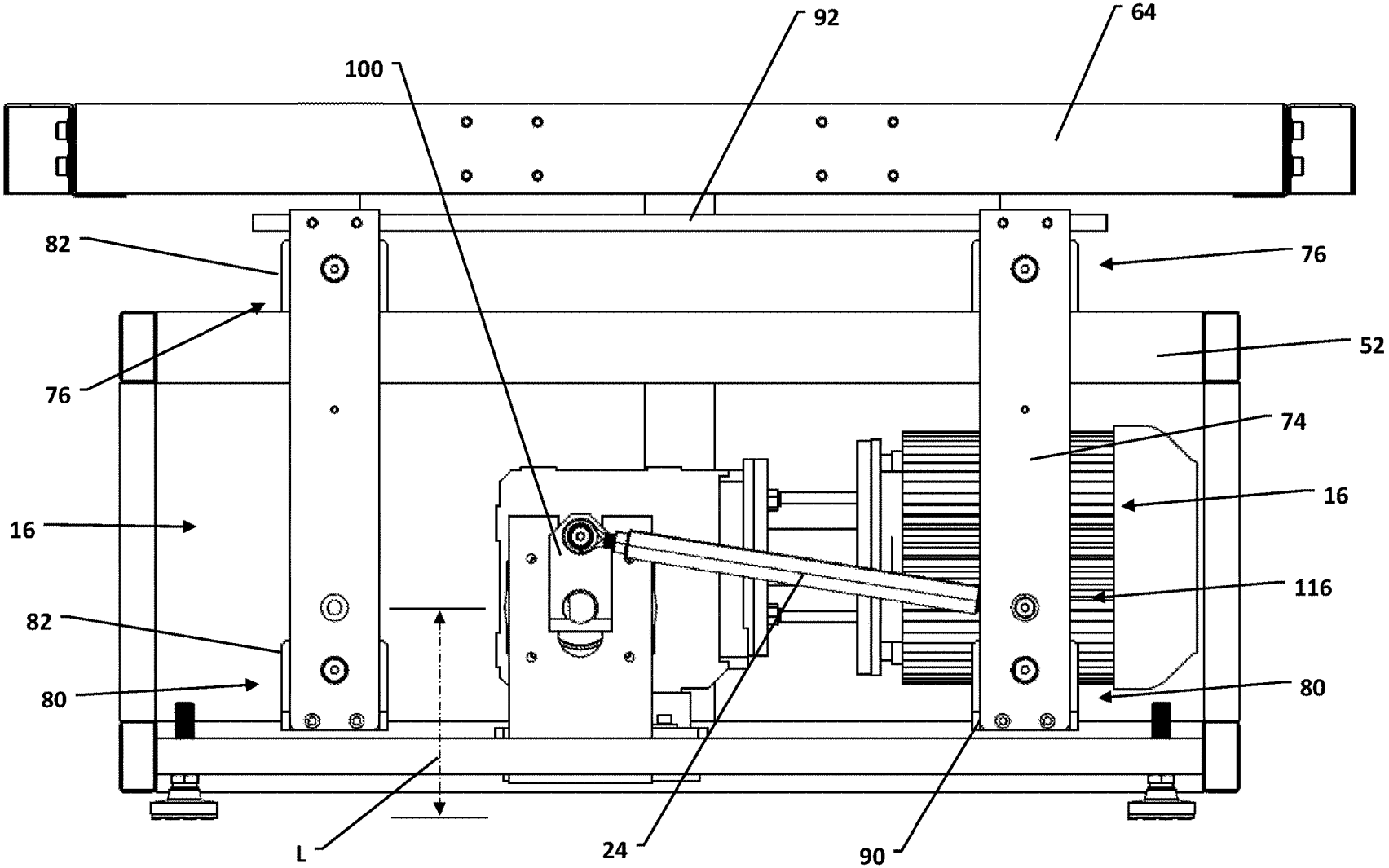
FIG. 7 is a sectional view taken along line 7-7 of FIG. 4, with an end view of a representative pair of swing arms.

Referring to FIGS. 6 and 7, respective pairs of the swing arms 16 connect each intermediate upper base cross member 52 to the overlying intermediate bed cross member 64. Each swing arm 16 includes a pair of base members 72 extending downwardly from opposite sides of the respective upper base cross member 52 and a pair of bed members 74 extending downwardly from opposite sides of the respective bed cross member 64.

A first pivot joint 76 connects the base member 72 upper ends to the respective intermediate upper base cross member 52 while a second pivot joint 80 connects the lower ends of the base members 72 and the bed members 74. Each pivot joint 76, 80 preferably includes a respective bearing block 82 with a ball bearing mounted therein. Upper and lower ends of the base members 72 connect to the ball bearings of the first and second pivot joints 76, 80 respectively.

The bearing block 82 of each first pivot joint 76 is mounted to the top of the respective intermediate upper base cross member 52. The bearing block 82 of each second pivot joint 80 is mounted to a bottom plate 90. Lower ends of each pair of bed members 74 are fixed to opposite sides of the respective bottom plate 90.

A common upper plate 92 connects the upper ends of the bed members 74 of each pair of swing arms 16. A pair of the bed frame mounting blocks 70 connect to an upper surface of each upper plate 92, with the bed frame mounting blocks 70 being secured within the respective intermediate bed frame cross member 64.

Figure 4:
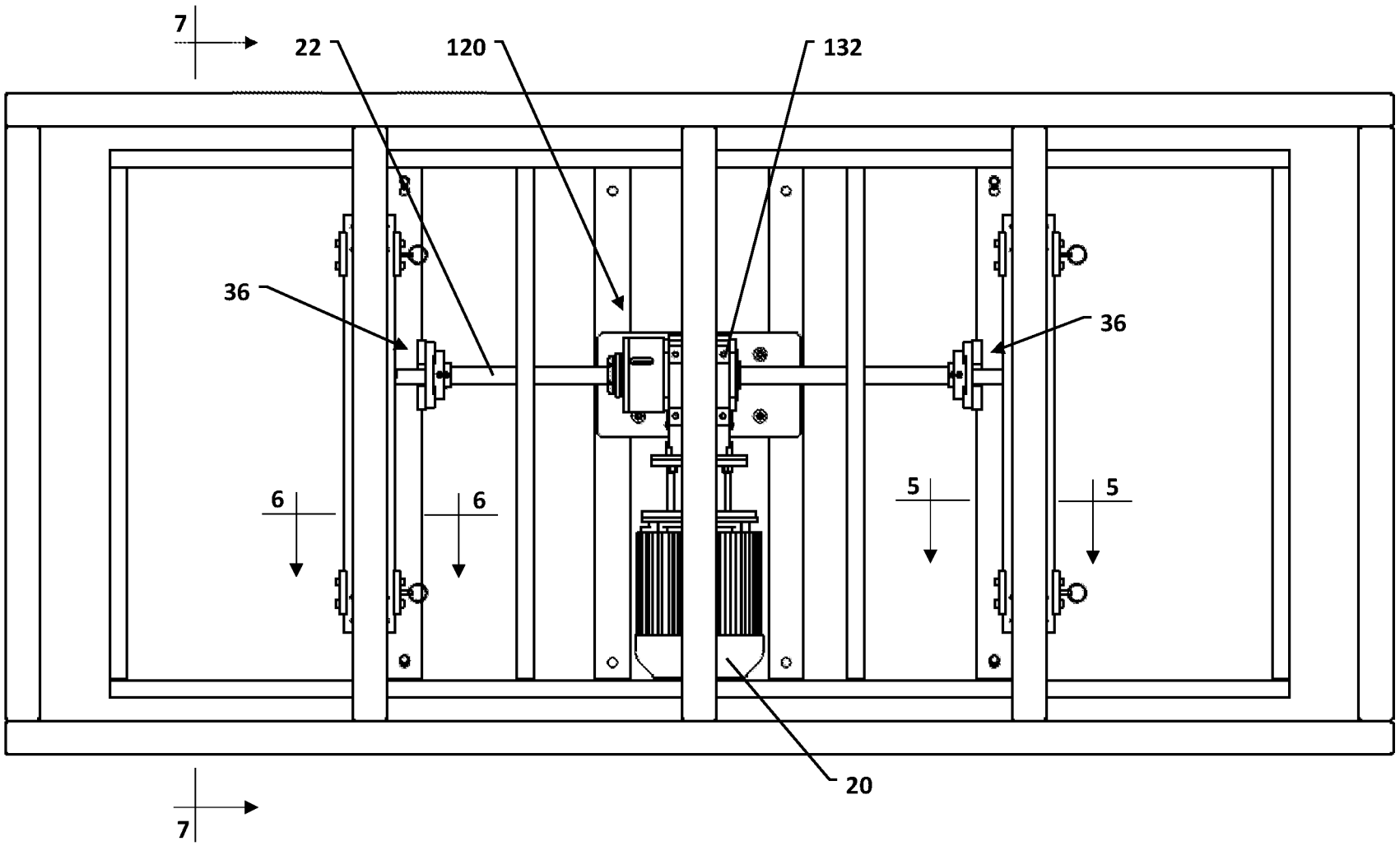
FIG. 4 is a top view of the moving bed assembly of FIG. 1.
Figure 8:
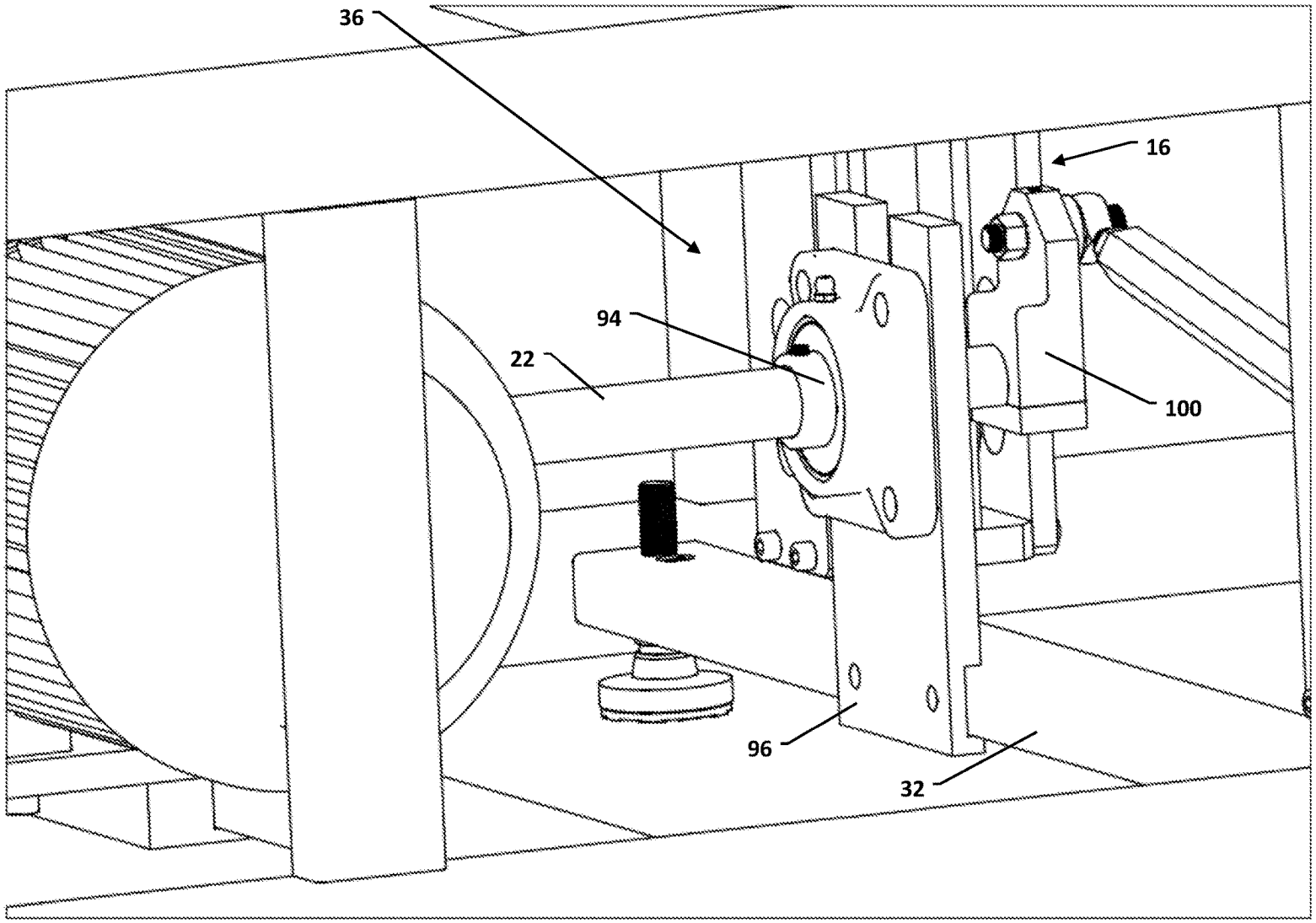
FIG. 8 is a detail view of a representative drive shaft end bearing of the moving bed assembly of FIG. 1.

Referring to FIGS. 4 and 8, near each end, the drive shaft 22 is supported by of the drive shaft end bearings 36 located proximate to a respective pair of the swing arms 16. Each drive shaft end bearing 36 is preferably a plain bearing including a bushing 94 mounted in a bearing support plate 96 connected to the respective intermediate lower base cross member 32. The drive shaft end bearings 36 help prevent any radial misalignment of the drive shaft 22 during operation and eliminate corresponding noticeable perturbations to the motion cycle of the bed frame 14.

Figure 9:
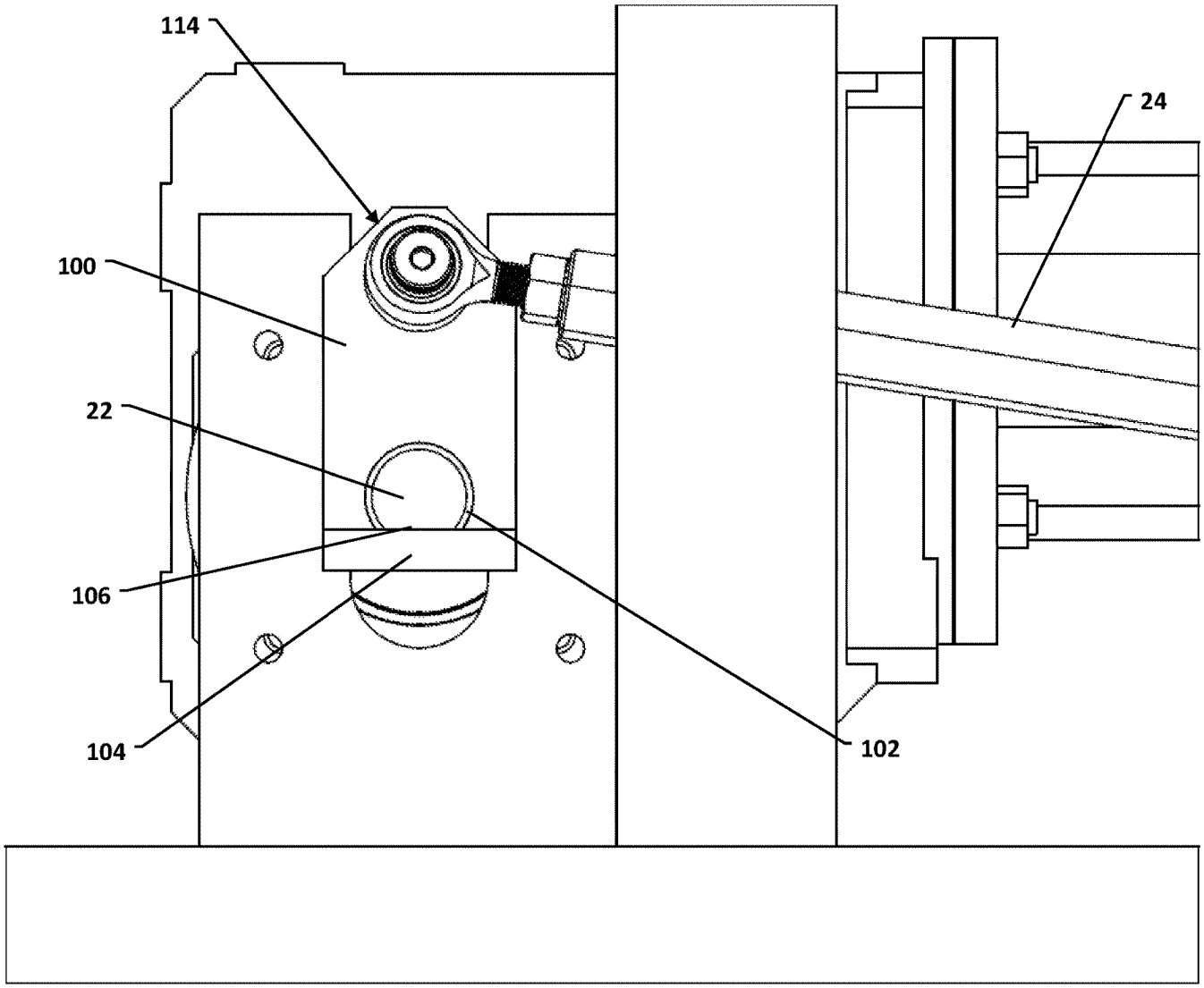
FIG. 9 is a detail view of a representative crank at an end of a drive shaft of the moving bed assembly of FIG. 1.

Referring to FIGS. 7 and 9, each end of the drive shaft 22 carries a crank 100 fixed to rotate therewith. Each drive shaft 22 end extends through a shaft passage 102 formed through one end of the respective crank 100. Each passage 102 opens onto 104 an adjacent end of the crank 100, allowing the drive shaft 22 to be securely clamped within the shaft passage 102 via an endplate 104. Each end of the drive shaft 22 includes a flat surface 106 that engages the endplate 104, ensuring proper radial alignment of each crank 100 on the drive shaft 22 and inhibiting rotation of the shaft 22 relative to the crank during operation. Preferably, the radial alignment of the crank 100 on each end of the drive shaft 22 is identical.

An opposite end of each crank 100 is connected to a crank end of a respective one of the drive arms 24 via a rotatable crank joint 114. A swing end of each drive arm 24 extends between, and is rotatably connected to, the base members 72 of one of each pair of swing arms 16 via a rotatably swing joint 116. Each of the joints 114, 116 is preferably a ball and socket joint (see also FIG. 3) allowing some rotation of each drive arm 24 about its axis during operation to accommodate some degree of misalignment between its crank and swing ends.

The radial displacement of each crank joint 114 from the drive shaft 22 by the crank 100 allows conversion of the rotation of the drive shaft 22 to a reciprocal motion of the drive arms 24. As used herein, in a "neutral" position of the drive shaft 22, there is no horizontal displacement between the rotational axes of the crank joints 114 and drive shaft 22. FIG. 7 depicts the drive shaft 22 in the neutral position, with the cranks 100 oriented vertically in the "twelve o'clock" direction. It will be appreciated that the drive shaft 22 would also be in the neutral position with each crank oriented vertically in the "six o'clock" direction.

In the neutral position, vertical levels L of the drive shaft 22 and the swing joints 116 of the swing ends of the drive arms 24 are equal. As used herein, the "vertical level" is referenced to a horizontal plane extending below a horizontally leveled base frame 12. This configuration results in the most direct application of force from the drive shaft 22 through the drive arms 24 throughout the entire motion cycle and further helps eliminate noticeable perturbations thereto. Additionally, the vertical level of the swing joints 116 is closer to lower ends of the base members 72 than upper ends thereof.

Figure 10:
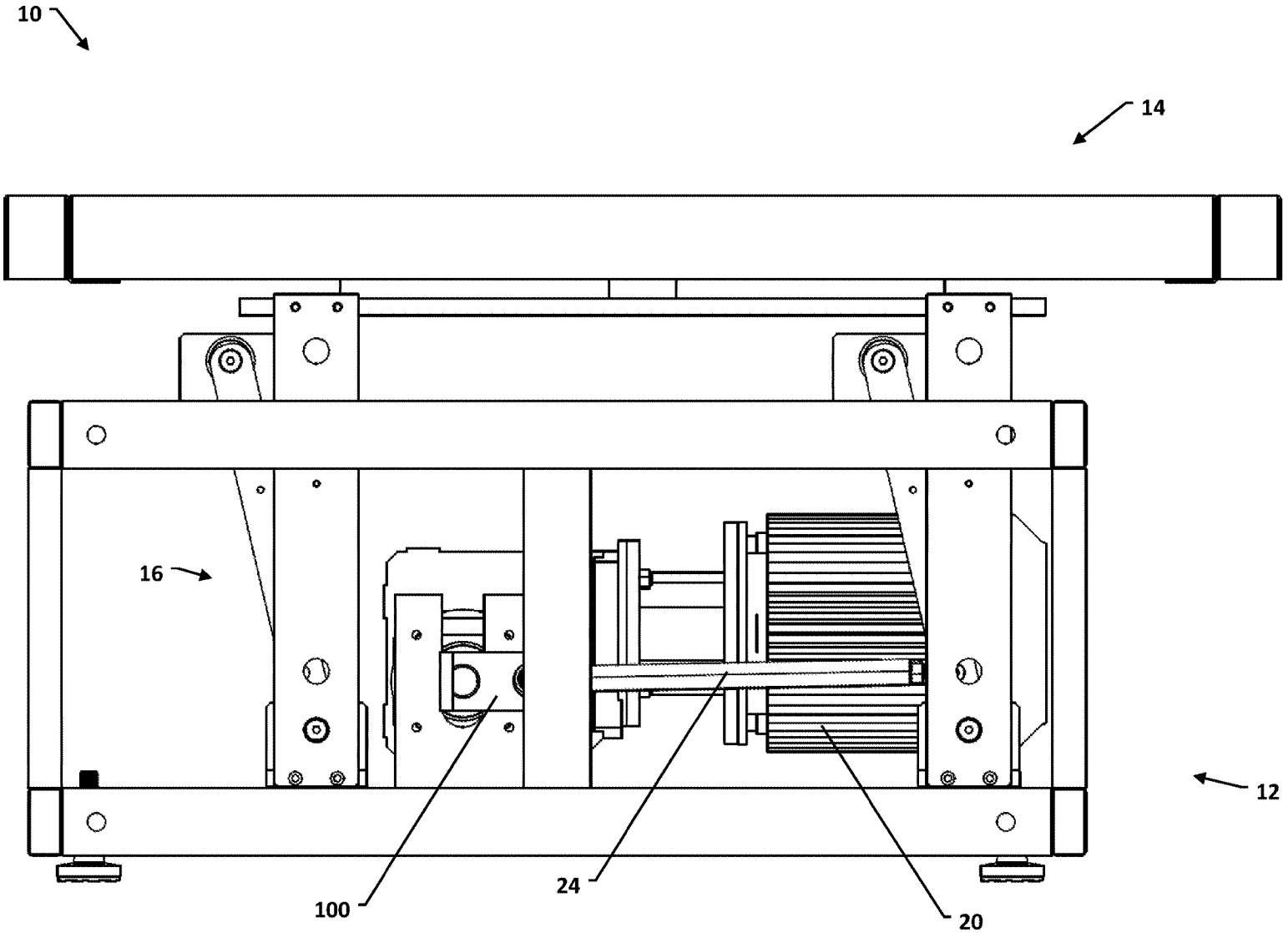
FIGS. 10 and 11 are end views of the moving bed assembly of FIG. 1, with a bed frame thereof at opposite extremes of movement.
Figure 11:
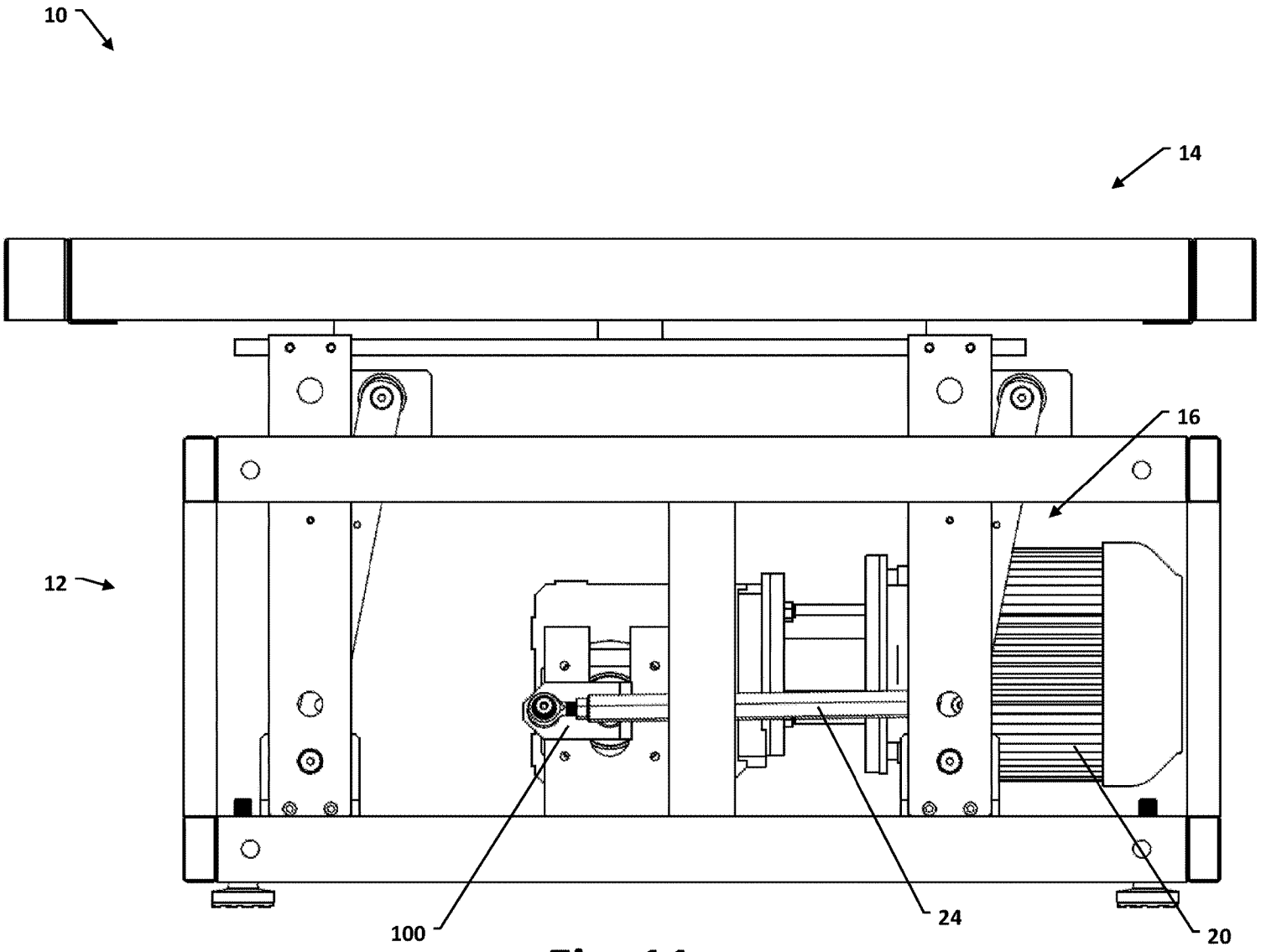

Opposite ends side-to-side motion of the bed frame 14 are achieved with the cranks 100 oriented in the "three o'clock" (FIG. 10) and "nine o'clock" (FIG. 11) directions. Advantageously, the total horizontal motion between the opposite extremes is between 4 and 5 inches, and more particularly, between 4.5 and 5 inches. Due to the angular motion of the swing arms 16, the bed frame 14 will also rise slightly with respect to, while remaining parallel with, a horizontal reference plane during each transition from a neutral position to either end of the motion cycle.

The present inventors have determined that another source of noticeable perturbations to the motion cycle occurs during the direction change at these opposite ends of the motion cycle. With reference to the drive shaft 22 position, these occur when the cranks 100 transition through the "three o'clock" and "nine o'clock" directions where the drive arms 24 switch from pushing to pulling and vice versa. In particular, under some load conditions on the bed frame 14, a noticeable "lurching" or "falling" sensation can sometimes be experienced.

Figure 12:
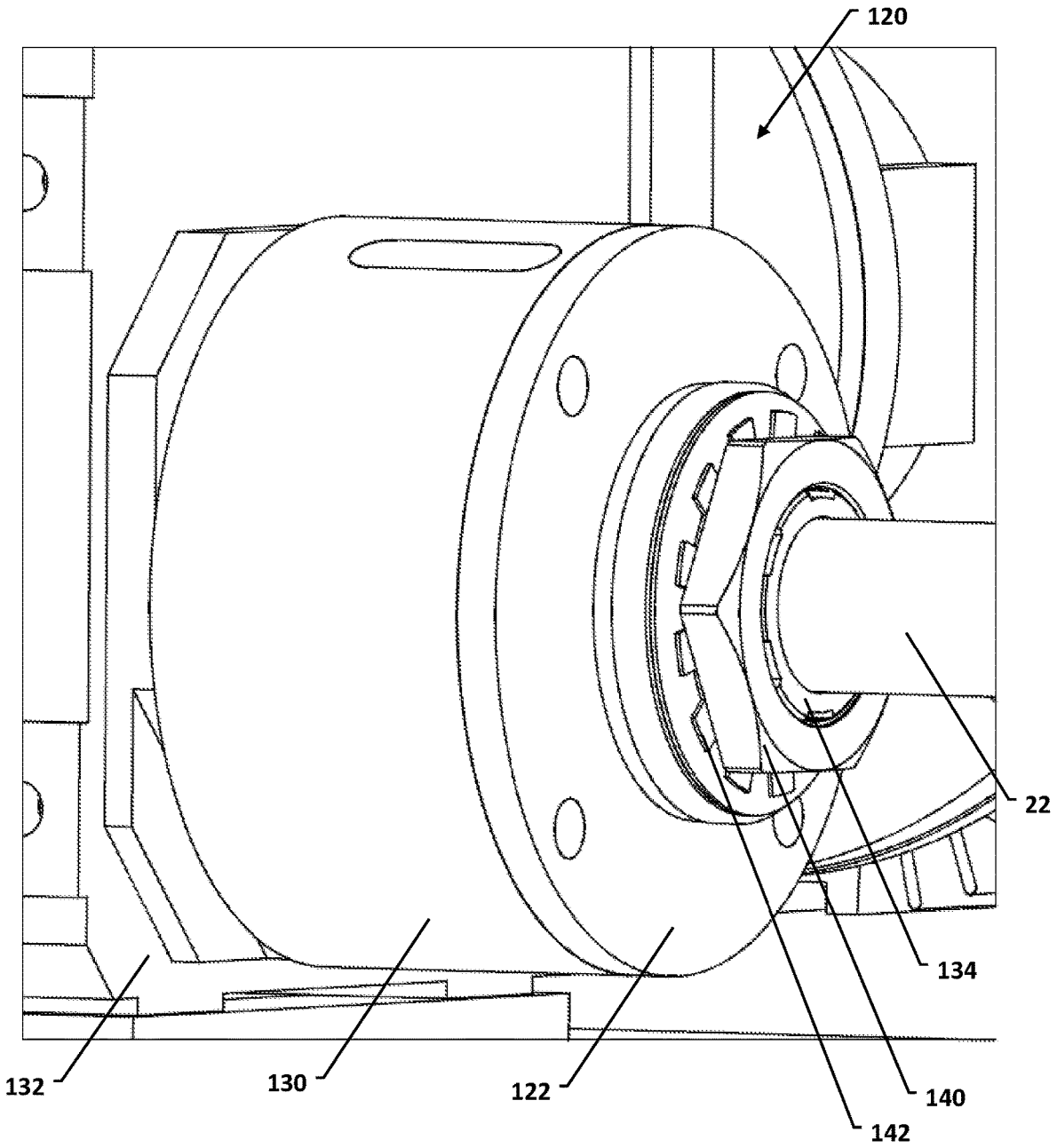
FIG. 12 is a detail perspective view of a shaft brake of the moving bed assembly of FIG. 1.
Figure 13:
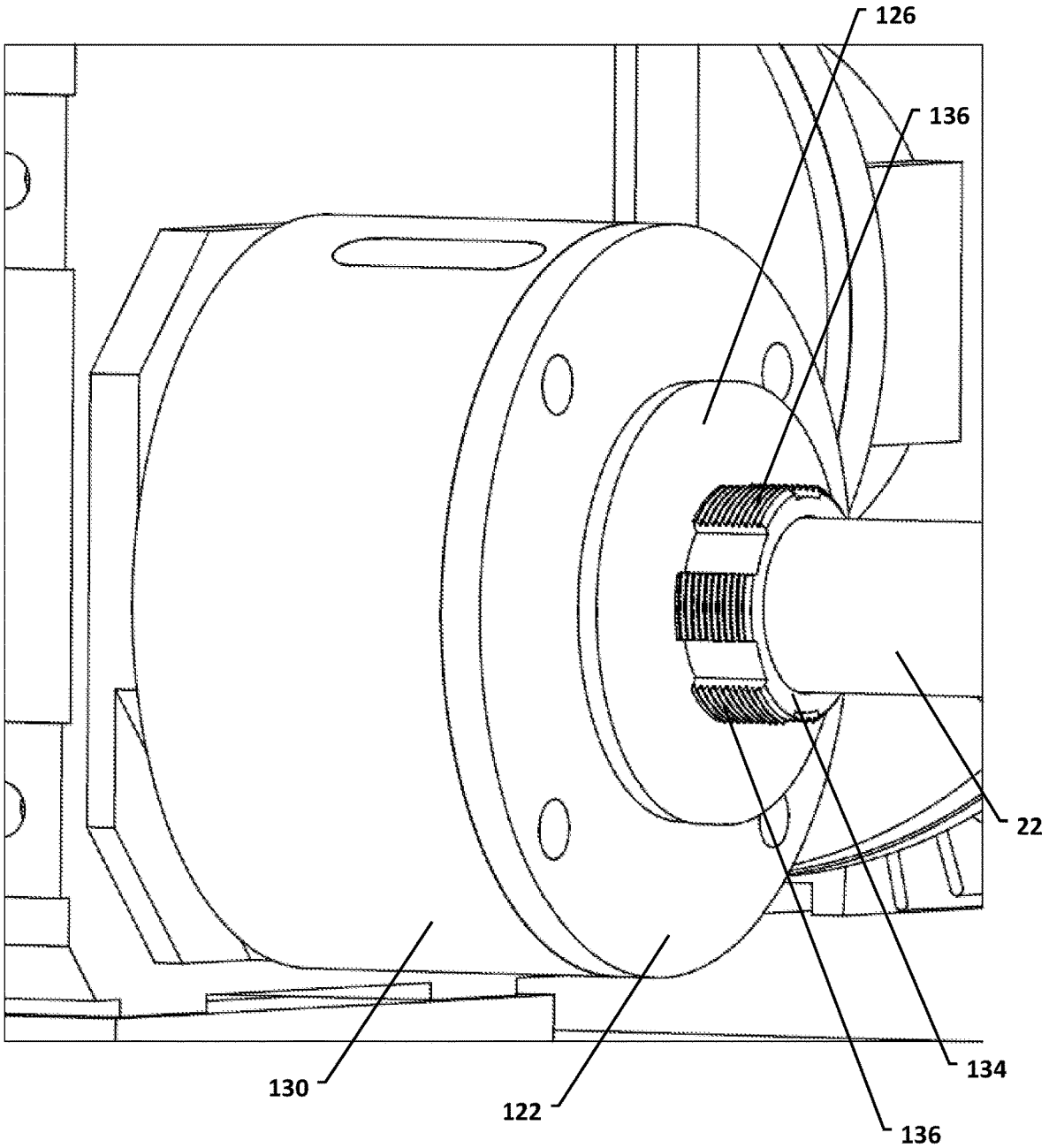
FIG. 13 is a detail perspective view of the shaft brake of FIG. 12, with a nut and spring thereof removed to show internal details.
Figure 14:
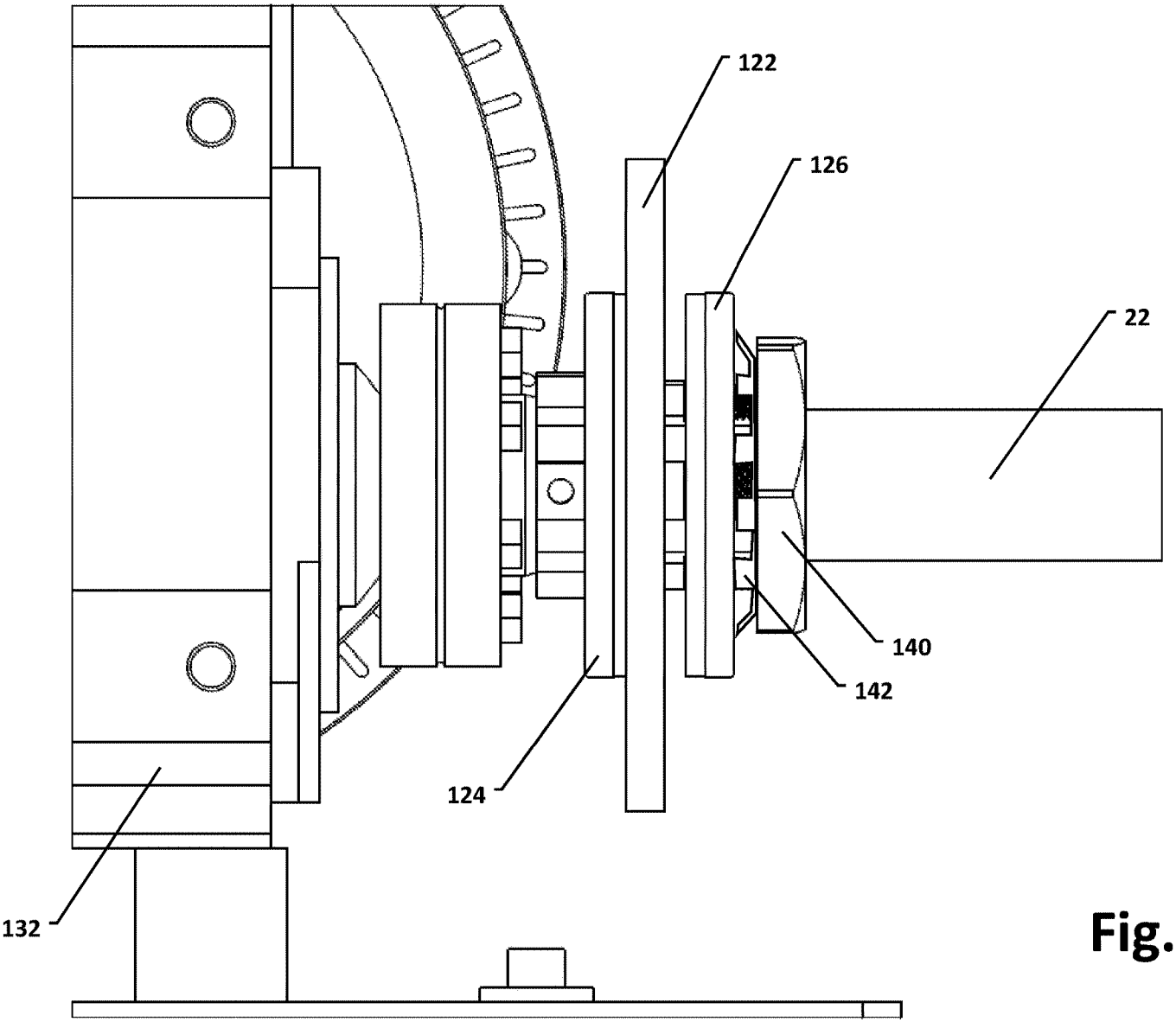
FIG. 14 is a side view of the shaft brake of FIG. 12 with a brake housing thereof removed to show internal details.

Advantageously, referring to FIG. 4 a shaft brake 120 is used to provide a constant preload on the drive shaft 22 during rotation and can effectively eliminate noticeable perturbations associated with these transitions in the motion cycle. Referring to FIGS. 12-14, the shaft brake 120 includes a stationary disc 122 through which the drive shaft 22 passes and which is engaged on opposite surfaces thereof by rotating friction pads 124, 126 carried by the drive shaft 22. In the depicted embodiment, the stationary disc 122 is held in place by a brake housing 130 mounted to a side of a transmission 132.

The friction pads 124, 126 are carried by a hub 134, with the friction pad 124 being located within the housing 130 and the friction pad 126 being located externally. The hub 134 is internally keyed to the drive shaft 22 to ensure rotation therewith. Externally, splines 136 are formed on the hub 134, the splines 136 having an increased diameter at an inner end of the hub 134 within the housing 130. Outer sections of the splines 136 are threaded.

The friction pads 124, 126 are internally splined so as to be rotationally coupled to the hub 134 and drive shaft 22 while being able to move axially relative thereto. The expanded diameter inner end of the splines 136 prevents the inner pad 124 from sliding off the hub 124 within the housing, while a nut 140 threads onto the splines 136 externally, retaining the outer pad 126.

A spring 142 is arranged between the nut 140 and the outer pad 126, allowing the braking force of the shaft brake 120 to be adjusted by tightening and loosening the nut 140. The spring 142 is internally splined like the pads 124, 126 and is preferably a toothed spring washer. The braking force can be advantageously adjusted if desired based on the anticipated bed loading.

Referring again to FIG. 4, the drive motor 20 preferably engages the drive shaft 22 through the transmission 132. With the rotational axis of the drive motor 20 being perpendicular to that of the drive shaft 22, the transmission 132 function both to change the direction of the rotational output of the drive motor 20 as well as to decrease the rotational speed (while increasing torque).

Figure 15:
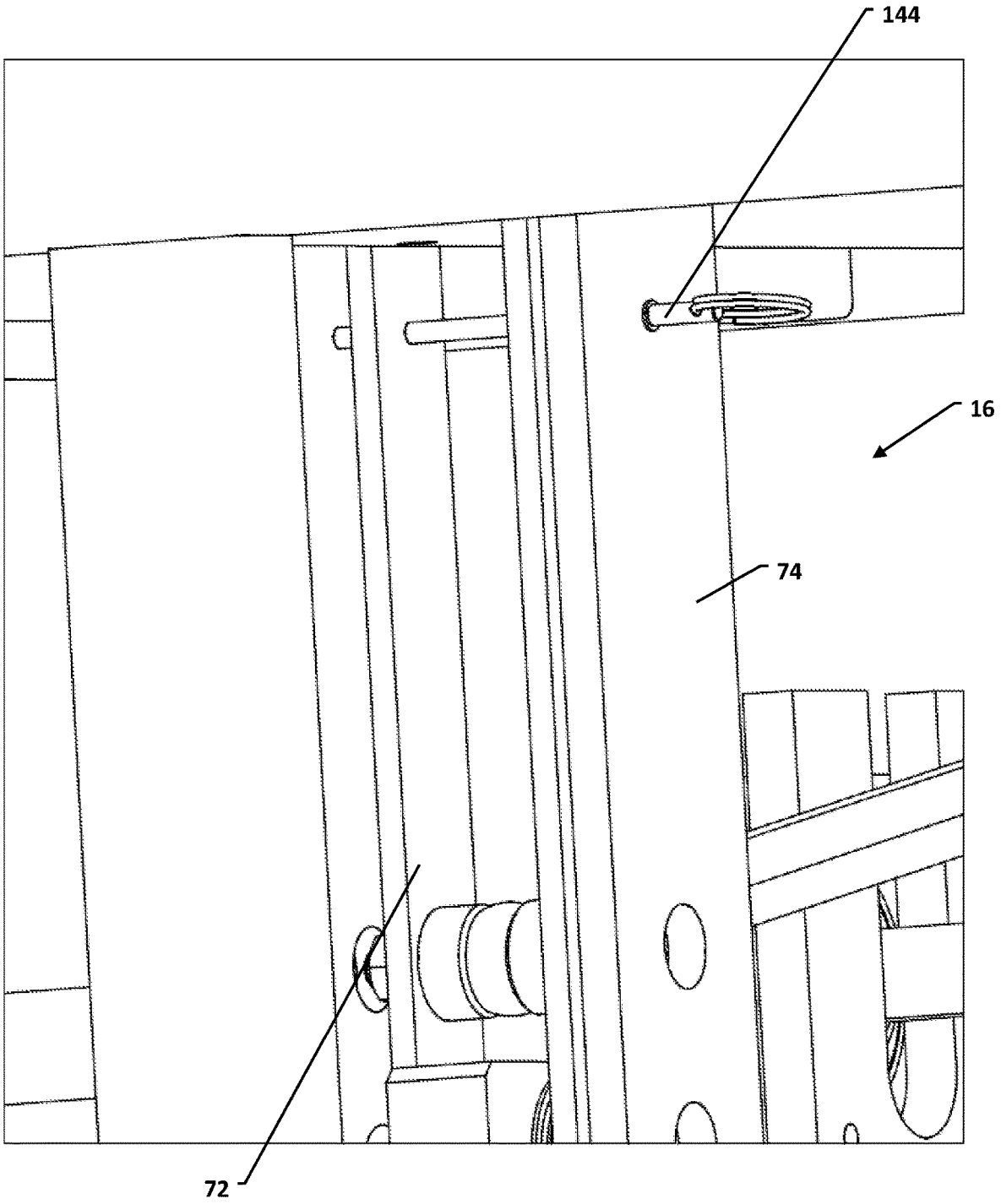
FIG. 15 is a detail perspective view of a representative swing arm having an alignment pin therein.

Referring to FIG. 15, for ensuring proper alignment during assembly and transport, alignment pins 144 are inserted through aligned holes in the base members 72 and bed members 74 of each swing arm 16. Connecting the bed frame 14 to the upper plates 92 connecting pairs of swing arms 16 allows the base frame 12 and swing arms 14 to remain fully assembled and aligned while still allowing the bed frame 14 to be readily detached and re-attached.

Figure 16:
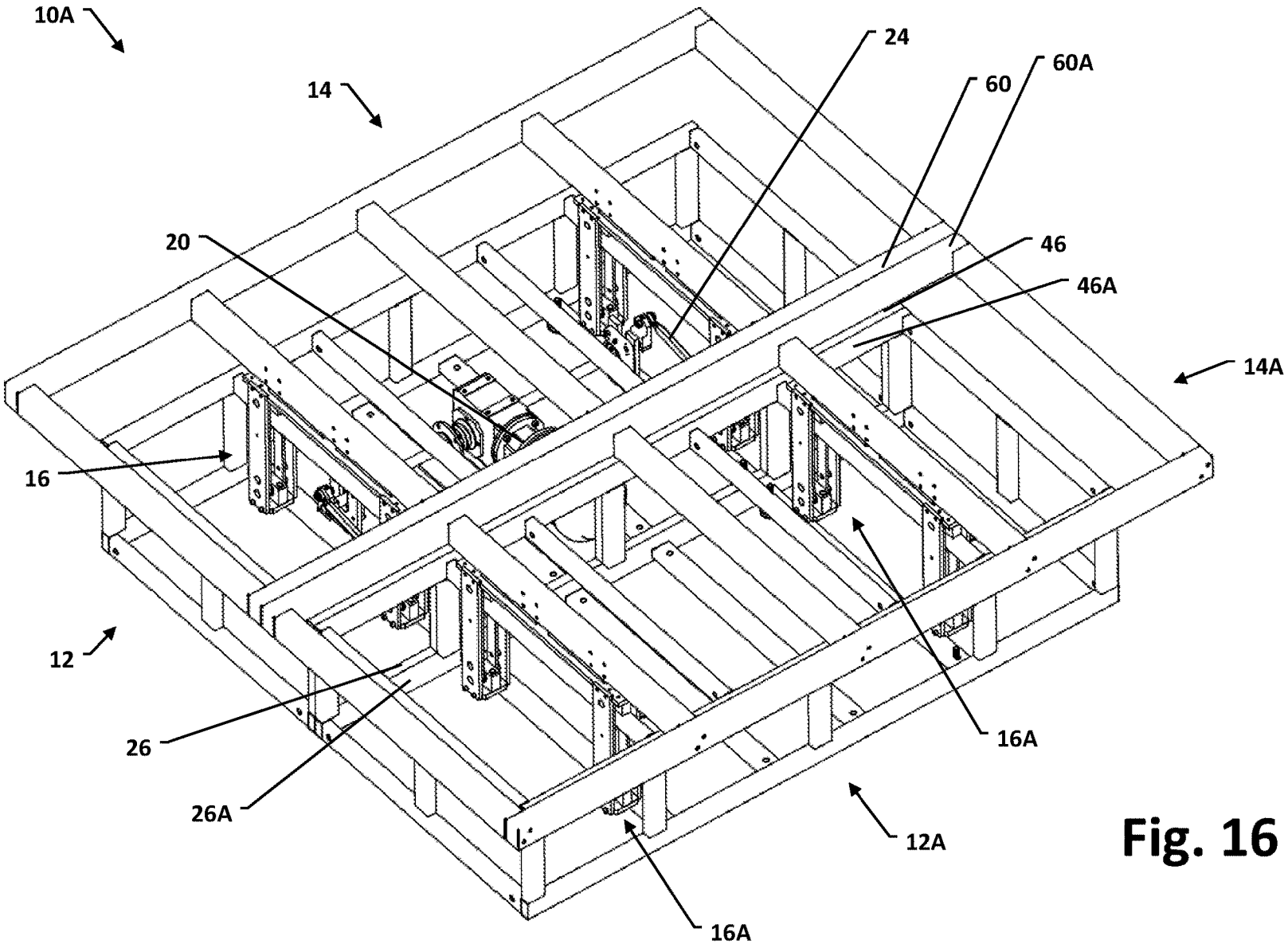
FIG. 16 is a perspective view of a modular moving bed assembly, according to another embodiment of the present invention, incorporating the moving bed assembly of FIG. 1 as a base unit thereof.

While it would be appreciated that a moving bed assembly according to the present invention could be made in any desired size, the above-described embodiment is dimensioned to accommodate a twin extra-long (XL) mattress on the bed frame 14. Besides simply changing the overall size to accommodate different mattress sizes, a modular approach can be used to make larger beds using the moving bed assembly 10 as a base unit with additional units added to achieve the desired size. In FIG. 16, a king-sized moving bed assembly 10A is formed by connecting the base frame 12 to an additional base frame 12A side-by-side such that respective ones of upper and lower pairs of additional base side members 26A, 46A abut respective ones of the upper and lower pairs of base side members 26, 46 and the additional base cross members extend in parallel with the base cross members. Likewise, the bed frame 14 is connected to an additional bed frame 14A such that one of the additional bed frame side members 60A abuts one of the bed frame side members 60 and the additional bed cross members extend in parallel with the bed cross members. The additional bed frame 14A is supported over the additional base frame 12A by additional swing arms 16A substantially identical to the swing arms 16.

With the exception of the absence of the motor 20, drive shaft 22 and other drive components, in the depicted king embodiment, the base frames 12, 12A and bed frames 14, 14A are substantially identical. However, to ensure proper centering of the adjoined bed frames 14, 14A over the adjoined base frames 12, 12A, attachment points of the bed frame mounting blocks to the intermediate bed cross members can be adjusted relative to the twin XL configuration. Preferably, the base frames 12A is connected to the side of the base frame 12 on which the drive arms 24 are connected to respective swing arms 16, making the contact points between the drive arms 24 and swing arms 16 closer to the center of the combined bed.

For other sizes of modular moving bed assemblies, it will be appreciated that additional base frames and additional bed frames having different widths than the initial base frame 12 and bed frame 14 could be used. For instance, to achieve a queen bed, the additional base and bed frames would be smaller than initial base and bed frames 12, 14.

Figure 17:
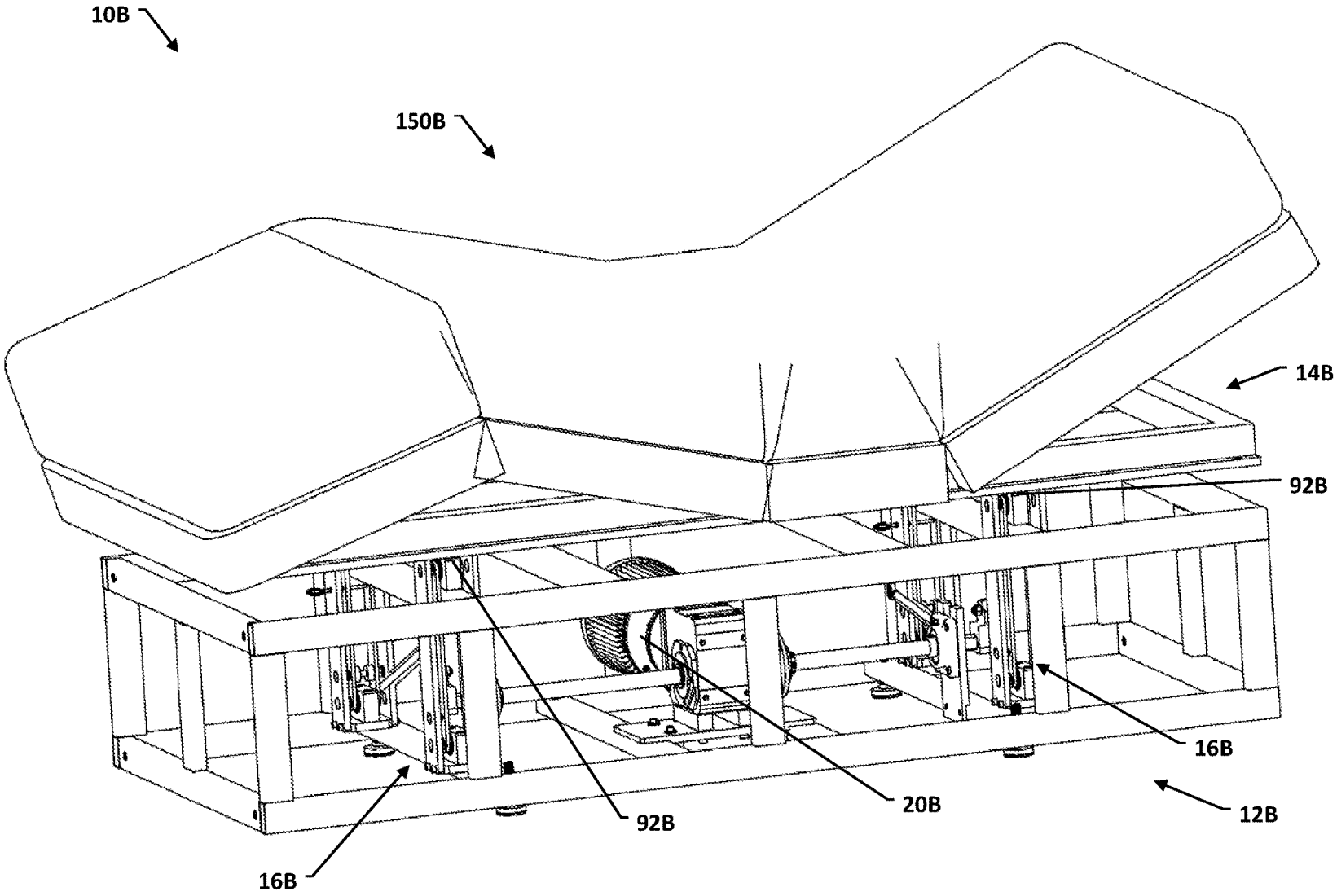
FIG. 17 is a perspective view of a moving bed assembly, according to a further embodiment of the present invention, including a bed frame with an articulated mattress arrangement thereon.

Referring to FIG. 17, in addition to supporting standard mattresses, a moving bed assembly 10B can support a bed frame 14B having an articulated mattress arrangement 150B located thereon. The bed frame 12B, swing arms 16B, motor 20B and associated drive components remain substantially identical to those discussed above in connection with the moving bed assembly 10. To reduce the overall height of the assembly 10B, as well as to more readily accommodate use of commercially-available articulated mattress arrangements, the bed frame 14B can mount directly to the upper plates 92B connecting the pairs of swing arms 16B, rather than mount via bed frame mounting blocks.

The above-described embodiments are provided for illustrative purposes; the present invention is not necessarily limited thereto. Rather, those skilled in the art will appreciate that various modifications, as well as adaptations to particular circumstances, will fall within the scope of the invention herein shown and described and of the claims appended hereto.

What is claimed is:

1. A moving bed assembly comprising a base frame including pairs of upper and lower base side members and a plurality of upper base cross members extending between the pair of upper base side members, a plurality of base vertical members supporting the pair of upper base side members over the pair of lower base side members;

a bed frame arranged over the base frame including a pair of bed side members and a plurality of bed cross members extending therebetween;

at least first and second pairs of swing arms supporting the bed frame for movement over the base frame, each of the pairs of swing arms being commonly connected between a respective one of the upper base cross members and a respective one of the bed cross members, each swing arm of the at least first and second pairs of swing arms including:

a pair of base members extending downwardly from base member upper ends attached to opposite sides of the respective one of the upper base cross members to base member lower ends;

a pair a bed members extending downwardly from bed member upper ends attached to opposite sides of the respective one of the bed cross members to bed member lower ends, the pair of base members being located between the pair of bed members;

a first pivot joint pivotably connecting the base member upper ends to the respective one of the upper base cross members; and a second pivot joint pivotably connecting the base member lower ends to the bed member lower ends;

a drive shaft rotatably mounted to the base frame and extending between a first shaft end and a second shaft end, the first shaft end carrying a first crank located between the first pair of swing arms, the second shaft end carrying a second crank located between the second pair of swing arms;

a first drive arm extending between a first drive arm crank end pivotably attached to the first crank and a first drive arm swing end pivotably connected to a first arm mount attached between the pair of base members of one of the first pair of swing arms;

a second drive arm extending between a second drive arm crank end rotatably attached to the second crank and a second drive arm swing end rotatably connected to a second arm mount attached between the pair of base members of one of the second pair of swing arms; and a drive motor mounted to the base frame and engaging the drive shaft and operable to impart rotational motion thereto;

wherein, in a neutral position of the bed frame, vertical levels of the drive shaft and the first and second drive arm swings ends are equal.

2. The moving bed assembly of claim 1, further comprising a shaft brake engaging the drive shaft between the first and second drive arm ends to apply a braking force thereto.

3. The moving bed assembly of claim 2, wherein the braking force applied by the shaft brake is adjustable.

4. The moving bed assembly of claim 1, further comprising a transmission mounted on the base frame, the drive motor engaging the drive shaft through the transmission.

5. The moving bed assembly of claim 4, wherein a shaft brake is mounted to a side of the transmission.

6. The moving bed assembly of claim 4, wherein a rotational axis of the drive motor is perpendicular to a rotational axis of the drive shaft.

7. The moving bed assembly of claim 1, wherein the vertical levels of the first and second drive arm swing ends are closer to the base member lower ends than to the base member upper ends.

8. The moving bed assembly of claim 1, further comprising:

an additional base frame including upper and lower pairs of additional base side members and a plurality of upper additional base cross members extending between the upper pair of additional base side members, a plurality of additional base vertical members supporting the upper pair of additional base side members over the lower pair of additional base side members, the additional base, the additional base frame being connected to the base frame such that respective ones of the upper and lower pairs of additional base side members abut respective ones of the upper and lower pairs of base side members and the additional base cross members extend in parallel with the base cross members;

an additional bed frame arranged over the additional base frame including a pair of additional bed side members and a plurality of additional bed cross members extending therebetween, the additional bed frame being connected to the bed frame such that one of the additional bed frame side members abuts one of the bed frame side members and the additional bed cross members extend in parallel with the bed cross members;

at least first and second additional swing arms supporting the additional bed frame for movement over the additional base frame, each of the additional swing arms being commonly connected between a respective one of the upper additional base cross members and a respective one of the additional bed cross members, each of the first and second additional swing arms being substantially identical to the first and second pairs of swing arms.

9. The moving bed assembly of claim 8, wherein the bed frame and the additional bed frame collectively define a king-sized bed frame.

10. The moving bed assembly of claim 1, wherein the bed frame is a twin extra long (XL) bed frame.

11. The moving bed assembly of claim 1, wherein the bed frame carries an articulated mattress support thereon.

12. A moving bed assembly comprising:

a base frame including upper and lower pairs of base side members and a plurality of upper base cross members extending between the upper pair of base side members, a plurality of base vertical members supporting the upper pair of base side members over the lower pair of base side members;

a bed frame arranged over the base frame including a pair of bed side members and a plurality of bed cross members extending therebetween;

at least first and second pairs of swing arms supporting the bed frame for movement over the base frame, each of the pairs of swing arms being commonly connected between a respective one of the upper base cross members and a respective one of the bed cross members, each swing arm of the at least two pairs of swing arms;

a drive shaft rotatably mounted to the base frame and extending between a first shaft end and a second shaft end, the first shaft end carrying a first crank;

a first drive arm extending between a first drive arm crank end rotatably attached to the first crank and a first drive arm swing end rotatably connected to drive the bed frame;

a drive motor mounted to the base frame and engaging the drive shaft and operable to impart rotational motion thereto; and a shaft brake engaging the drive shaft between the first and second drive arm ends to apply a braking force thereto;

wherein, in a neutral position of the bed frame, vertical levels of the drive shaft and the first and second drive arm swings ends are equal.

13. The moving bed assembly of claim 12, wherein the braking force applied by the shaft brake is adjustable.

14. The moving bed assembly of claim 12, further comprising a transmission mounted on the base frame, the drive motor engaging the drive shaft through the transmission.

15. The moving bed assembly of claim 13, wherein the shaft brake is mounted to a side of the transmission.

16. The moving bed assembly of claim 13, wherein a rotational axis of the drive motor is perpendicular to a rotational axis of the drive shaft.

17. The moving bed assembly of claim 12, wherein each swing arm of the at least first and second pairs of swing arms includes:

a pair of base members extending downwardly from base member upper ends attached to opposite sides of the respective one of the upper base cross members to base member lower ends;

a pair a bed members extending downwardly from bed member upper ends attached to opposite sides of the respective one of the bed cross members to bed member lower ends, the pair of base members being located between the pair of bed members;

a first pivot joint pivotably connecting the base member upper ends to the respective one of the upper base cross members; and a second pivot joint pivotably connecting the base member lower ends to the bed member lower ends.

18. The moving bed assembly of claim 17, wherein the first shaft end is located between the first pair of swing arms and the first drive arm swing end is pivotably connected to a first arm mount attached between the pair of base members of one of the first pair of swing arms.

19. The moving bed assembly of claim 18, wherein the second shaft end carries a second crank located between the second pair of swing arms, and a second drive arm extends between a second drive arm crank end pivotably attached to the second crank and a second drive arm swing end pivotably connected to a second arm mount attached between the pair of base members of one of the second pair of swing arms.

20. The moving bed assembly of claim 19, wherein the vertical levels of the first and second drive arm swing ends are closer to the base member lower ends than to the base member upper ends.

* * * * *